US006616003B1

(12) United States Patent
Polenta

(10) Patent No.: US 6,616,003 B1
(45) Date of Patent: Sep. 9, 2003

(54) PLASTIC MOULDED BOX WITH COMPACTIBLE STRUCTURE, OF IMPROVED TYPE

(75) Inventor: Flavio Polenta, Camerano (IT)

(73) Assignee: King Plast - S.p.A., Polverigi (IT)

( * ) Notice: Subject to any disclaimer, the term of this patent is extended or adjusted under 35 U.S.C. 154(b) by 0 days.

(21) Appl. No.: 10/217,349

(22) Filed: Aug. 9, 2002

(51) Int. Cl.[7] ..... B65D 6/00
(52) U.S. Cl. ..... 220/7; 220/6
(58) Field of Search ..... 220/6, 7

(56) References Cited

U.S. PATENT DOCUMENTS 4,181,236 A * 1/1980 Prodel ..... 220/6
4,953,735 A * 9/1990 Tisbo et al. ..... 220/6
5,938,059 A * 8/1999 Luburic ..... 220/6
6,209,741 B1 * 4/2001 Boucher-Giles ..... 220/6
6,405,888 B1 * 6/2002 Overholt et al. ..... 220/6
6,460,717 B1 * 10/2002 Smyers et al. ..... 220/6

* cited by examiner

*Primary Examiner*—Joseph M. Moy
(74) *Attorney, Agent, or Firm*—Armstrong, Westerman & Hattori, LLP

(57) ABSTRACT

The present invention relates to a plastic moulded box, of improved type, having an articulated compactible structure, capable of considerably reducing the box height when the box is stored or not used, thanks to the fact that the walls can collapse inwards until the upper perimeter frame touches the bottom of the box.

1 Claim, 4 Drawing Sheets

PLASTIC MOULDED BOX WITH COMPACTIBLE STRUCTURE, OF IMPROVED TYPE

The present patent application relates to a plastic moulded box, of improved type, having an articulated compactible structure, capable of considerably reducing the box height when the box is stored or not used, thanks to the fact that the walls can collapse inwards until the upper perimeter frame touches the bottom of the box.

STATE OF THE ART

More precisely, the box of the invention is of the type comprising a first rectangular upper frame that defines the opening of the box, a second rectangular lower frame that is an integral part of the bottom of the box and four lateral articulated walls, of which the transversal walls can collapse upwards and inwards, while the longitudinal walls fold inwards, being composed of an identical overlapped pair of semi-borders, hinged to the upper and lower frame, respectively, and mutually hinged on their conjunction axis.

The purpose of the present invention is to improve the resistance of the pivoting pins of the longitudinal walls to the lower frame that defines the bottom, under the stress caused by shocks or falls.

In most cases breakage occurs when the box suffers accidental shocks being in compact position, that is with the four lateral walls collapsed inwards and with the upper frame lowered and positioned on the lower frame that defines the bottom.

Breakage is favoured by the compact position because when the longitudinal walls lose their vertical position and lay on the bottom of the box, the longitudinal walls are less rigid and vibrate, being without load.

In other words, the longitudinal walls are more subjected to the inertia discharged on them when the box is closed and suffer an accidental shock, such as, for example, when handling the box and accidentally dropping it on the floor.

Obviously, inertia stresses the pivoting pins of the walls, which are the only connection constraints between the longitudinal walls and the lower frame of the bottom.

The pins are not dimensioned to withstand high shearing or bending stress since their only function is to allow the longitudinal walls of the box to collapse inwards and resist to vertical stress when the box is open.

PURPOSE OF THE INVENTION

The purpose of the invention is to make pivoting pins less vulnerable to breakage without overdimensioning them.

DESCRIPTION OF THE INVENTION

The improved box of the invention is characterised by longitudinal partitions protruding from the bottom and located immediately beside the connection hinges between the bottom and the longitudinal walls.

The partitions are shaped and dimensioned in such a way that they can stop the longitudinal walls when the same are folded inwards until they lay on the bottom.

The improved box of the invention is also characterised by the fact that the longitudinal walls have a transversal series of wedge-shaped protuberances, which create friction against the external side of the partitions when the longitudinal wall is folded inwards. Thanks to the interference between the partitions and the wedge-shaped protuberances the longitudinal wall is stopped, thus completely recovering the travel of the hinge.

It can be said that the improved box of the invention is provided with locking means for the longitudinal borders in collapsed position, in order to prevent any possible movement between the longitudinal walls and the bottom, thus relieving the longitudinal walls from any inertial stress in case of external shocks on the bottom.

DESCRIPTION OF DRAWINGS

For major clarity the description of the box according to the present invention continues with reference to the enclosed drawings, which are intended for purposes of illustration and not in a limiting sense, whereby.

DESCRIPTION OF A PREFERRED EMBODIMENT OF THE INVENTION

Figure 1:
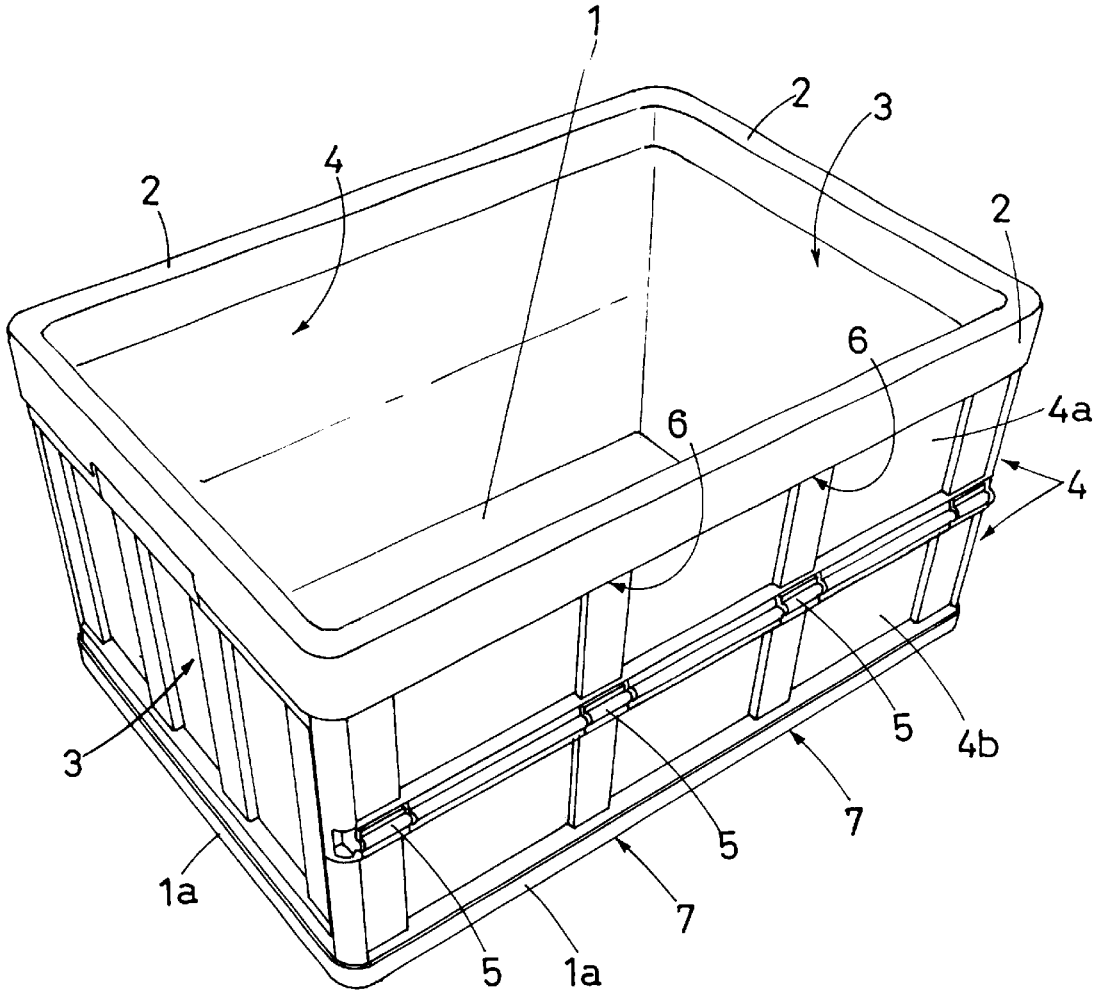
FIG. 1 is a perspective diagrammatic view of the box of the invention.
Figure 2:
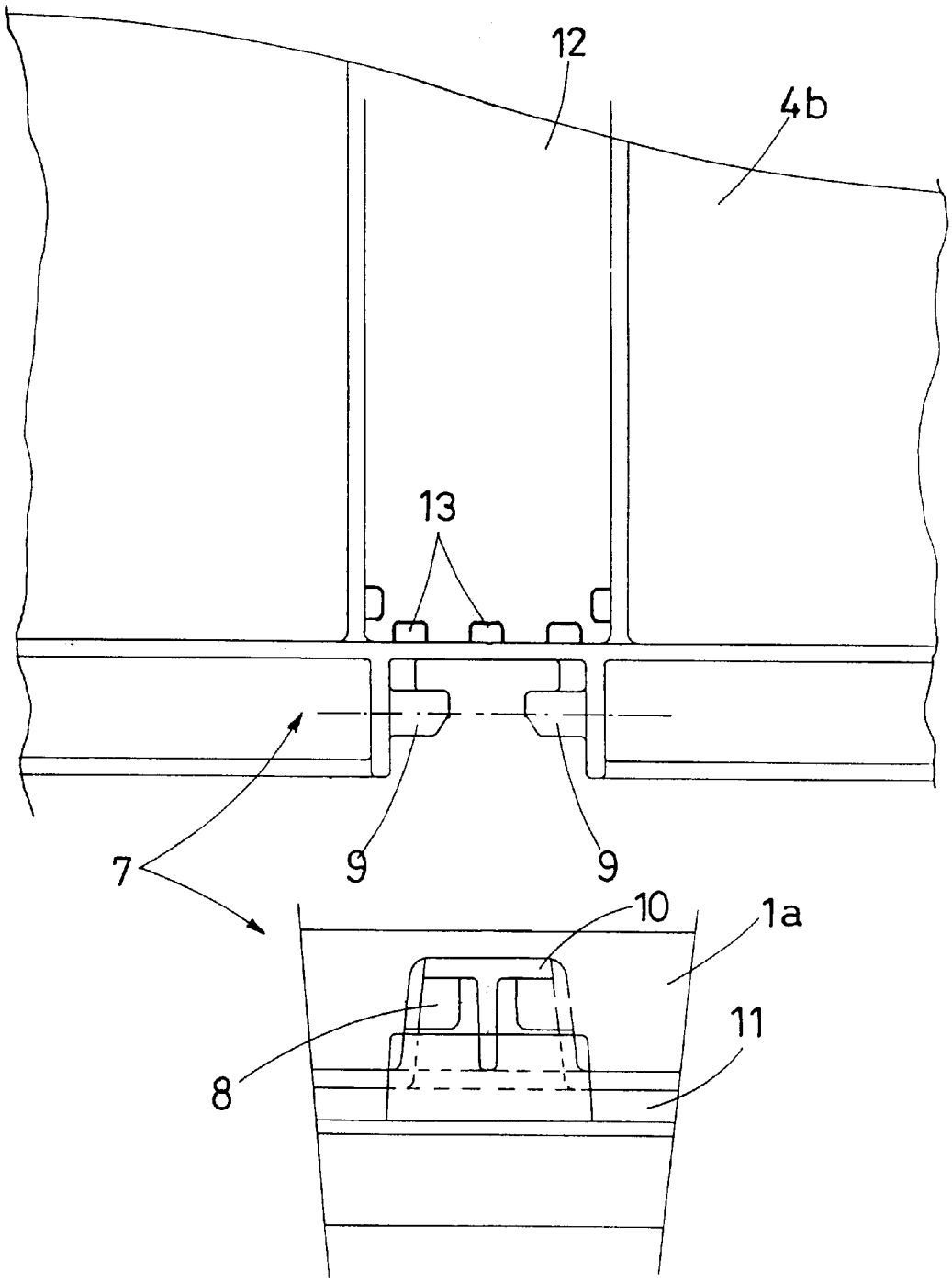
FIG. 2 is an inside view of one pair of pivoting pins used to hinge the longitudinal wall to the border of the bottom, also shown in the figure, for a short section that corresponds to the housing of the pivoting pins.
Figure 4:
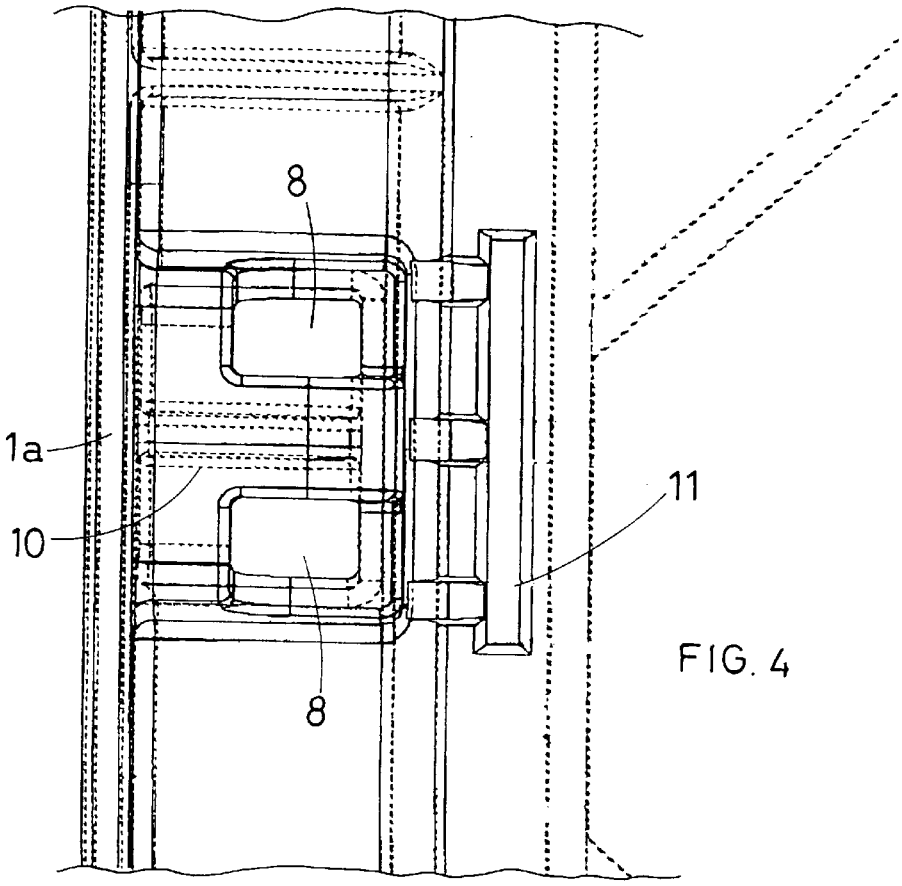
FIG. 4 is a top view of a short section of the border of the bottom that corresponds to the housing of the pivoting pins.

With reference to the aforementioned figures the box of the invention is of the type having a compactible structure, whose bearing elements are represented by a traditional rectangular bottom (1) that incorporates a perimeter frame (1*a*) and an upper frame (2), realised with a sort of box-type rib and having profile and dimensions exactly identical to the profile and perimeter dimensions of the bottom (1).

The two elements (1 and 2) can be defined as bearing elements because the four lateral walls of the box are hinged on them.

Practically speaking, the two transversal walls (3) of the box of the invention are hinged inside the corresponding transversal section of the bearing upper frame (2).

The hinging mode is such that each wall (3) can go from the operating vertical position to a non-operating horizontal position further to the inward upward rotation of the box.

A different method has been used to reduce the vertical volume of the longitudinal walls (4) of the box. Each wall (4) is composed of an overlapped pair of identical rectangular panels (4*a* and 4*b*) with longitudinal development, which can fold thanks to the presence of hinges (5) along their conjunction side.

It must be noted that the upper horizontal border of the upper panel (4*a*) of each longitudinal wall (4) is hinged by hinges (6) to the corresponding section of the bearing upper frame (2), while the lower horizontal border of the lower panel (4*b*) is hinged by hinges (7) to the corresponding section of the lower frame (1*a*) of the bottom (1) of the box.

Thanks to the hinging modes, each longitudinal wall (4) can go from an operating position in which the two panels (4*a* and 4*b*) are contained inside the same vertical plane, to a non-operating position in which the same panels (4*a* and 4*b*) rotate towards the inside of the box in overlapped horizontal position, in which the external side of the upper panel (4*a*) touches the external side of the lower panel (4*b*).

The improvement of the box of the invention relates to the hinges (7), whose pins have shown poor mechanical resistance when the box is closed and suffers shocks, that is with the upper frame (2) against the lower frame (1*a*), being an integral part of the bottom (1) of the box.

It must be said that the hinge (7) is traditionally composed of a housing (8) for the pivoting pins (9), which is located on an ear (10) moulded together with the bottom (1).

Figure 3:
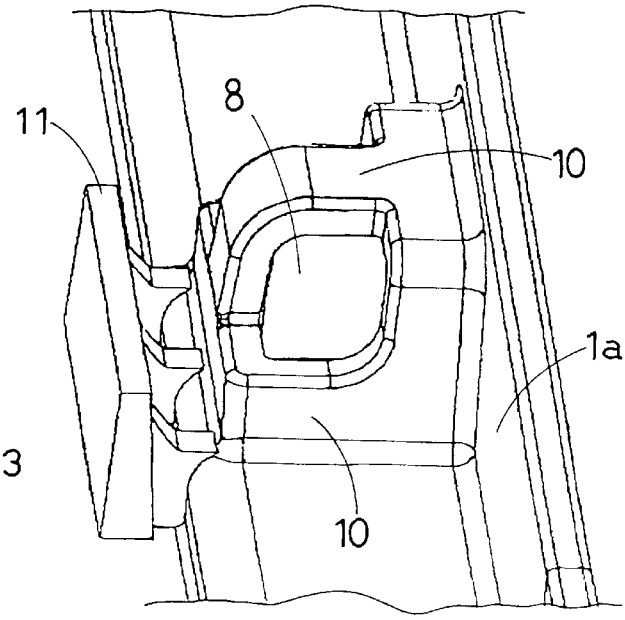
FIG. 3 is an axonometric view of a short section of the border of the bottom that corresponds to the housing of the pivoting pins.

With particular reference to FIG. 3, it can be noted that the ear (10) protrudes from the bottom (1) and is joined to the perimeter frame (1*a*).

The hinge (7) includes an opposite coaxial pair of pins (9) located on the lower panel (4b) of the longitudinal walls (4) capable of being inserted in the housing (8) from opposite sides.

The coupling of the pins (9) and the housing (8) occurs by forcing the ear (10) between the opposite pair of pins (9), which—because of the interference—bend elastically and snap inside the housing (8) as soon as the housing (8) is aligned with the opposite pair of pins (9).

Obviously, the assembly of the hinge (7) requires that the housing (8) is slightly larger than the diameter of the pins (9), so that the coupling between the pins (9) and the housing (8) enjoys a small space that allows the longitudinal walls (4) to vibrate, especially when they are folded inside the box in closed position.

The improved box of the invention is characterised by longitudinal partitions (11) protruding from the bottom (1) and located immediately beside the hinges (7).

Figure 6:
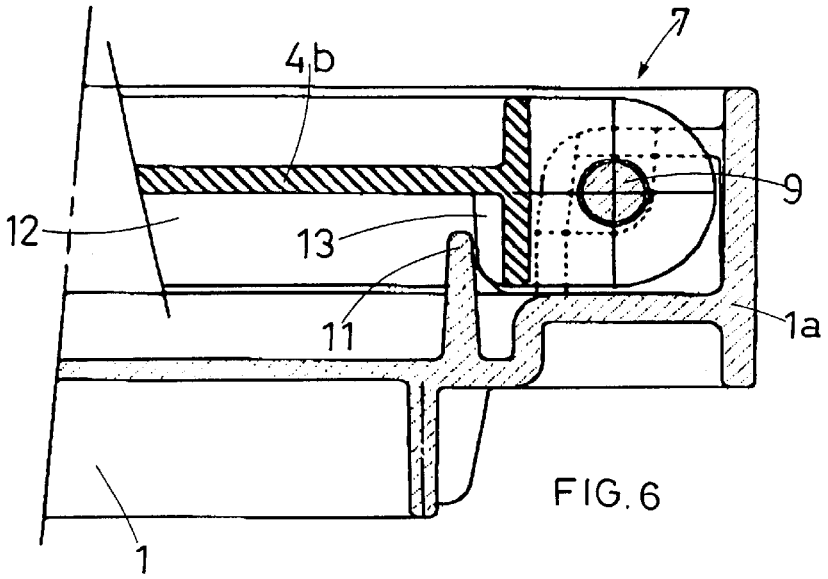
FIG. 6 is a cross-section of the pivoting hinge between the border of the bottom and the longitudinal wall in horizontal position, collapsed inside the box.
Figure 5:
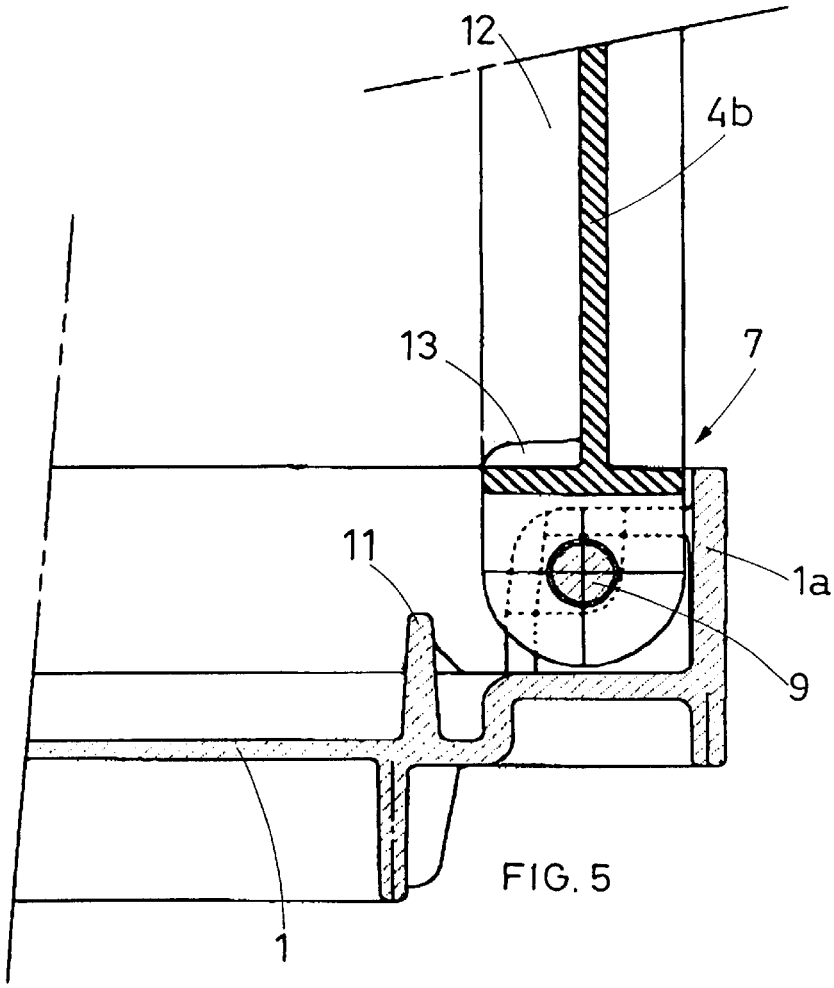
FIG. 5 is a cross-section of the pivoting hinge between the border of the bottom and the longitudinal wall in vertical position.

As shown in FIG. 6, the partitions (11) are shaped and dimensioned in such a way that they can stop the longitudinal walls (4) when the same are folded inwards until they lay on the bottom (1) of the box.

The improved box of the invention is also characterised by the fact that the lower panel (4*b*) of each longitudinal wall (4) has a vertical groove (12) in internal position on each hinge (7), which exactly ends above the opposite pair of pins (9) on the lower border of the panel (4*b*).

The bottom of the vertical groove (12) has a transversal series of wedge-shaped protuberances (13) that create friction against the external side of the partitions (11), which act as locking jaw for the panel (4b) and consequently for the entire longitudinal wall (4) folded and completely collapsed.

What is claimed is:

1. A plastic molded box having an articulated compactible structure comprising:

a rectangular bottom (1) having a perimeter frame (12) and at least one ear (10) formed on the rectangular bottom;

an upper frame (2);

two opposite transversal walls (3), each hingedly connected to the upper frame (12);

two opposite longitudinal walls (4), each wall being formed from an upper rectangular panel (4*a*) and a lower rectangular panel (4b), the rectangular panels (4*a* and 4*b*) overlapping one another;

each upper panel (4*a*) being connected by first hinges (15) to each lower panel (4*b*), each upper panel (4*a*) further being connected by second hinges (6) to the upper frame (2), each lower panel (4*b*) further being connected by third hinges (7) to the lower frame (12);

each third hinge (7) having an opposite coaxial pair of pins (6) disposed on the respective lower panel (4*b*);

a housing (8) formed on the at least one ear (10) on the rectangular bottom (1), the pins (9) on each third hinge (7) being inserted in the housing (8);

longitudinal partitions (11) disposed immediately beside the third hinge (7) and protruding from the rectangular bottom (1);

a vertical groove (12) formed internally on each third hinge (7), each vertical groove extending above the opposite pair of pins (9), each vertical groove having a bottom;

a wedge-shaped protuberance (13) formed on the bottom of each vertical groove, each wedge-shaped protuberance creating friction against the longitudinal partitions (11) when the longitudinal walls are folded inside the box.

* * * * *